US008678545B2

(12) United States Patent
Nishimura et al.

(10) Patent No.: US 8,678,545 B2
(45) Date of Patent: Mar. 25, 2014

(54) INKJET HEAD AND INKJET RECORDING APPARATUS

(71) Applicants: Hideaki Nishimura, Kanagawa (JP); Yukitoshi Tajima, Kanagawa (JP)

(72) Inventors: Hideaki Nishimura, Kanagawa (JP); Yukitoshi Tajima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/770,383

(22) Filed: Feb. 19, 2013

(65) Prior Publication Data

US 2013/0215188 A1 Aug. 22, 2013

(30) Foreign Application Priority Data

Feb. 20, 2012 (JP) ..... 2012-034376

(51) Int. Cl.
*B41J 2/165* (2006.01)

(52) U.S. Cl.
USPC ..... 347/29; 347/22; 347/71

(58) Field of Classification Search
USPC ..... 347/22, 29, 44, 47, 65, 71
See application file for complete search history.

(56) References Cited

U.S. PATENT DOCUMENTS

2007/0257957 A1* 11/2007 Takagi ..... 347/29
2013/0021412 A1 1/2013 Nishimura et al.

FOREIGN PATENT DOCUMENTS

JP 10-016240 1/1998
JP 2005-186525 7/2005
JP 2011-000778 1/2011

OTHER PUBLICATIONS

U.S. Appl. No. 13/609,897, filed Sep. 11, 2012, Hideaki Nishimura et al.
K.D.Budd, et al., "Sol-Gel Processing of $PbTiO_3$, $PbZrO_3$, PZT, and PLZT Thin Films", Proc.Brit.Ceram.Soc., 36, 1985, pp. 107-121.

* cited by examiner

*Primary Examiner* — Thinh Nguyen
(74) *Attorney, Agent, or Firm* — Oblon, Spivak, McClelland, Maier & Neustadt, L.L.P.

(57) ABSTRACT

An inkjet head includes an actuator substrate provided with a pressure generating chamber, a nozzle plate provided with multiple nozzle holes discharging liquid to form a nozzle surface opposite to a recording media, a common passage substrate provided with a common passage to supply liquid to the pressure generating chamber, and a cover member to cover a perimeter of the nozzle surface, with an opening to expose the nozzle holes. In a prescribed direction, a dimension of the opening of the cover Lc, an external dimension of the actuator substrate La, an external dimension of the nozzle plate Ln, and an external dimension of the common passage substrate Lm, satisfy inequalities, La≤Lc<Ln≤Lm. A supporting member is provided between the opposing surface of the nozzle surface and the surface of the common passage substrate facing to the nozzle plate, to support the nozzle plate.

10 Claims, 12 Drawing Sheets

INKJET HEAD AND INKJET RECORDING APPARATUS

BACKGROUND OF THE INVENTION

1. Field of the Invention

The disclosures herein generally relate to an inkjet head provided in an inkjet recording apparatus used as an image forming apparatus such as a printer, a facsimile machine, a copy machine, etc, and an inkjet recording apparatus using the inkjet head.

2. Description of the Related Art

In general, as an image forming apparatus used for a printer, a facsimile machine, a copy machine, a plotter, or a combined machine of these, for example, there is an inkjet recording apparatus, with which an inkjet head is provided to discharge ink droplets to be attached to a medium, or a sheet, being conveyed, to form an image.

Here, a medium is also called a "sheet", which is not intended to limit the material of the medium. Other terms are also used such as a material for recording, a recording medium, a transfer medium, a recording sheet. Also, an "image forming apparatus" means an apparatus configured to form an image by discharging liquid onto a medium such as paper, strings, fiber, cloth, leather, metals, plastic, glass, woods, ceramics and the like. Also, "image forming" means not only to form an image attached with meanings such as characters, figures and the like onto a medium, but to form an image without patterns or meanings onto a medium, such as just discharging droplets onto a medium. Also, "ink" is not limited to so-called ink, which can be any material discharged as liquid, for example, DNA samples, photoresist, patterning materials, resin or the like.

An inkjet head of an inkjet recording apparatus may have an actuator substrate on which multiple pairs of a pressure generating section and a pressure generating chamber are formed. The pressure generating section includes an electromechanical transducer such as a piezoelectric device. In the pressure generating chamber, which communicates with multiple nozzle holes, pressure is generated to discharge ink from the nozzle holes. The inkjet head may also have a common passage substrate on which a common passage is provided to supply ink to each of the pressure generating chambers, and a nozzle plate on which multiple nozzle holes are formed into a nozzle surface opposite to a sheet, to discharge ink in the pressure chamber. The common passage substrate, the actuator substrate and the nozzle plate are layered in order to be attached. The inkjet recording apparatus applies pressure to ink in the pressure generating chamber with the pressure generating section, to discharge ink from the nozzle holes on the nozzle plate, which forms an image on a medium.

An inkjet head described in the patent document 1, has a frame and a head cover. The frame covers the perimeter of the nozzle surface so that an opening is formed to expose the nozzle holes and the periphery. The head cover has side surfaces folded at the frame to cover the side surfaces of the inkjet head. With this structure, it is possible to protect side surfaces of the inkjet head from external forces induced when the side surfaces touch a wiper to wipe the nozzle surface of the inkjet head to remove unnecessary ink, or the side surfaces touch a sheet.

As a manufacturing method of an inkjet head, MEMS (micro-electro-mechanical systems) technology is adopted, which is a micromachining technology utilizing semiconductor processes. For example, manufacturing methods such as etching, stuttering, and the like are used to form necessary parts for an inkjet head on a silicon substrate. The parts may include a liquid chamber, a vibrating plate, a piezoelectric device, an electrode, and the like. To make an inkjet head smaller, these parts are formed smaller, and/or disposed elaborately. As a result, a greater number of inkjet heads can be made from a plate of silicon substrate (semiconductor substrate). The smaller the size is, the lower the cost.

In a conventional inkjet head, at least an actuator substrate and a nozzle plate are formed with substantially the same external dimensions. With this, the nozzle plate can be supported by the actuator substrate, which can prevent the nozzle plate from deforming when the head cover touches the wiper to push the nozzle plate.

However, if the actuator substrate is made larger to support the nozzle plate more firmly, a fewer number of parts can be taken from the same plate of silicon substrate (semiconductor substrate), which leads to a higher cost of an inkjet head.

Patent Literature

1. Japanese Laid-open Patent Publication No. 2011-000778. Japanese

Non-Patent Literature

1. K. D. Budd, S. K. Dey, D. A. Payne, Proc. Brit. Ceram. Soc., 36,107 (1985)

SUMMARY OF THE INVENTION

It is a general object of at least one embodiment of the present invention to provide an inkjet head with a lower cost without deteriorating print quality, and an inkjet recording apparatus provided with the inkjet head.

According to at least one embodiment of the present invention, an inkjet head includes an actuator substrate provided with a pressure generating chamber, a nozzle plate provided with multiple nozzle holes discharging liquid stored in the pressure generating chamber by a pressure generating section, the multiple nozzle holes being formed on a nozzle surface opposite to a recording media, a common passage substrate provided with a common passage to supply liquid to the pressure generating chamber, and a cover member to cover at least a perimeter of the nozzle surface, with an opening formed to expose the nozzle holes and a periphery of the nozzle holes. In a prescribed direction, a dimension of the opening of the cover Lc, an external dimension of the actuator substrate La, an external dimension of the nozzle plate Ln, and an external dimension of the common passage substrate Lm, satisfy inequalities, $La \leq Lc < Ln \leq Lm$. A supporting member is provided in a space surrounded by an opposing surface of the nozzle surface of the nozzle plate, a surface of the common passage substrate facing to the nozzle plate, and external side surfaces of the actuator substrate, to support the nozzle plate by attaching to the opposing surface of the nozzle surface and the surface of the common passage substrate facing to the nozzle plate.

According to at least one embodiment of the present invention, in a prescribed direction, an external dimension of an actuator substrate is smaller than an external dimension of the nozzle plate substrate. This makes it possible to take a greater number of parts from a silicon substrate (semiconductor substrate) than the number of parts in the case where the external dimension of the actuator substrate and the nozzle plate are the same in a certain direction, which leads to a lower cost of an inkjet head. Also, since the nozzle plate is supported by a supporting member contacting the opposing surface to the nozzle surface of the nozzle plate, it is possible to prevent the nozzle plate from deforming when pushed by the cover. Thus, it is possible to prevent print quality from deteriorating with variations of an interval between the nozzle plate and recording media caused by a deformed nozzle plate.

As above, according to at least one embodiment of the present invention, it is possible to provide an inkjet head with a lower cost without deteriorating print quality.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 2:
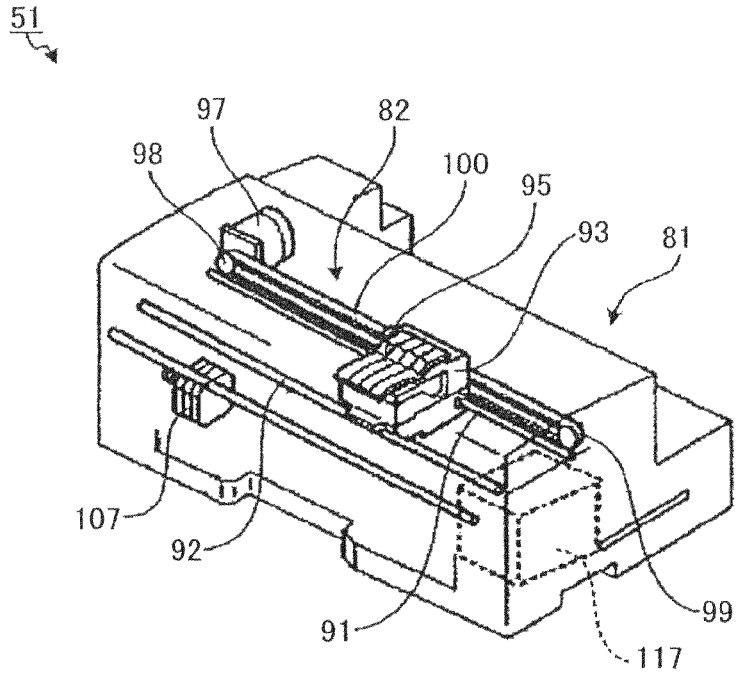
FIG. 2 is a perspective view of an inkjet recording apparatus according to an embodiment.
Figure 3:
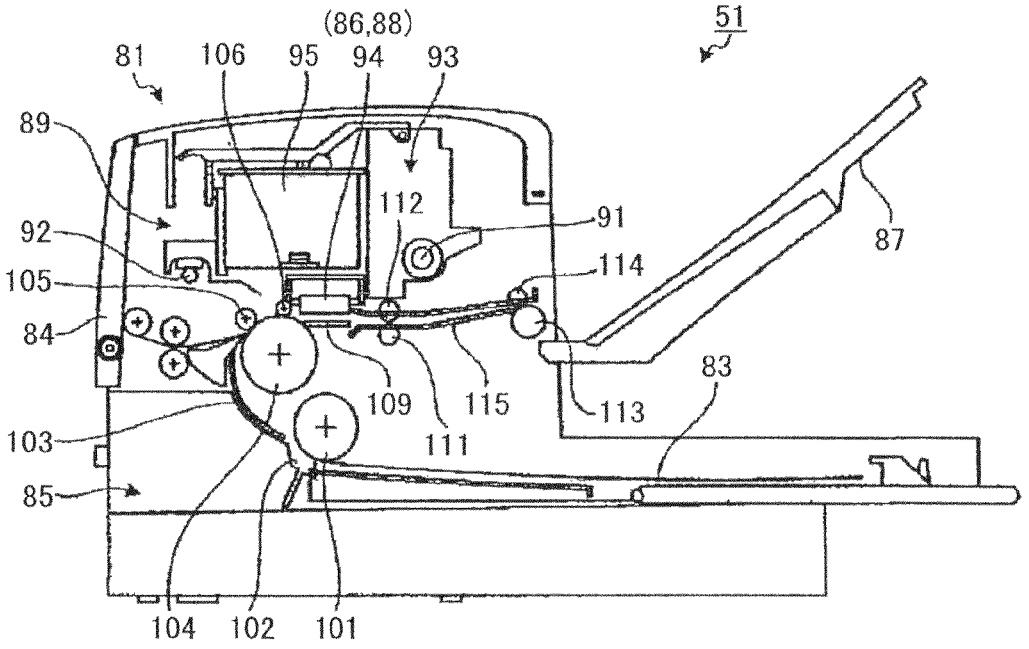
FIG. 3 is a cross-sectional view of an inkjet recording apparatus according to an embodiment.

In the following, an inkjet recording apparatus will be explained according to an embodiment of the present invention. FIG. 2 is a explanatory perspective view of an internal structure of the inkjet recording apparatus according to the present embodiment. FIG. 3 is a explanatory side view of the internal structure of the inkjet recording apparatus when viewing in a main scanning direction perpendicular to a conveying direction of a sheet 83, or a medium, according to the present embodiment.

An inkjet recording apparatus 51 in the present embodiment provides a carriage 93 in a main body 81, moveable in the main scanning direction. The carriage 93 is equipped with an inkjet head 94 which can be easily attached or detached, and ink cartridges 95 supplying ink to the inkjet head 94.

The inkjet recording apparatus 51 also provides a paper feed cassette 85, which may be a paper feed tray, to hold plural sheets of paper, or media 83, at a lower part of the main body 81. The inkjet recording apparatus 51 in the present embodiment also provides a manual feeding tray 84 for feeding the sheets 83 manually. The manual feeding tray 84 can be opened outward to be pulled down (leftward in FIG. 3), which enables to feed the sheets 83 also from the manual feeding tray 84. A sheet 83 fed from the paper feed cassette 85 or the manual feeding tray 84 is conveyed through a respective route to a mechanical section for printing 89 equipped with the carriage 93, where images are recorded with ink discharged from the inkjet head 94. Then, the sheet 83 on which images have been recorded is ejected to a paper output tray 87 provided in the rear side (rightward in FIG. 3).

The mechanical section for printing 89 holds the carriage 93 with a main guide rod 91 and a secondary guide rod 92 which are guiding members supported by left and right side plates (not shown). The carriage 93 is held in such a way that it can slide freely along the main scanning direction. The carriage 93 has the inkjet head 94 provided with groups of nozzles (groups of ink discharge holes) to discharge ink of colors, yellow, cyan, magenta, and black. The inkjet head 94 can be easily attached or detached. Each of the groups of nozzles for the colors are aligned to cross the main scanning direction, to form rows of nozzles. The inkjet head 94 is attached to the carriage 93 in such a way that the nozzle surface on which the nozzles are formed for the colors is directed vertically downward.

The carriage 93 has the ink cartridges 95 attached, which are exchangeable, to provide ink of the colors to the inkjet head 94. The ink cartridge 95 has an air inlet on the upper part to communicate with the atmosphere, an ink supplying outlet on the lower part to supply ink to the inkjet head 94, and a porous body inside filled with ink. Capillary force of the porous body gives a bit negatively biased pressure to the ink to be supplied to the inkjet head 94. It is noted that although a single inkjet head 94 is configured with multiple color nozzles in the present embodiment, it is possible to adopt another configuration in which an individual inkjet head 94 is provided for each of the colors.

In the present embodiment, the backside of the carriage 93 is fit around the main guide rod 91 in such a way that the carriage 93 slides freely. The back side is the downstream side of sheet conveyance. The front side of the carriage 93 is placed on the secondary guide rod 92 in such a way that the carriage 93 slides freely. The front side is the upstream side of sheet conveyance. A timing belt 100 is wrapped around and stretched between a driving pulley 98 driven by a main scanning motor 97, and a driven pulley 99. The carriage 93 is fixed to the timing belt 100. With forward and reverse rotations of the main scanning motor 97, the carriage 93 can be reciprocated in the main scanning direction along the main rod 91 and the secondary rod 92.

In the present embodiment, to convey the sheets 83 in the paper feed cassette 85 to a place for printing under the inkjet head 94, the following parts are provided: a sheet feeding roller 101 and a friction pad 102 to separate and feed one of the sheets 83 from the paper feed cassette 85, a guiding member 103 to guide the sheet 83, a conveying roller 104 to convey and flip the sheet 83, a pressing roller 105 pressed to the perimeter of the conveying roller 104, and a tip end roller 106 to set an ejecting angle of the sheet 83 from the pressing roller 105. The conveying roller 104 is driven rotationally by a secondary scanning motor 107 via a series of gears.

The sheet 83 coming out from the conveying roller 104 whose width corresponds to the moving range of the carriage in the main scanning direction, is conveyed onto a printed sheet supporting member 109, which is provided as a guiding member to guide the sheet 83 under the recording head 94. In the direction to which sheets are conveyed from the printed sheet supporting member 109, the following parts are provided: a pressing roller 111 which is driven rotationally to feed the sheet 83 in the direction of ejection, a spur 112 disposed opposite to the pressing roller 111, ejection rollers 113 and 114 to feed the sheet 83 to the paper output tray 87, and guiding members 115, 116 to form an ejection route for the sheet 83.

When recording an image on the sheet 83, the inkjet head 94 is driven in response to image signals, and discharges ink onto the sheet 83 stopped for the moment for recording a line of image data while the carriage 93 is moved. Then, the sheet 83 is conveyed by a predetermined amount to record the next line. By receiving a signal indicating the completion of the recording or a signal indicating that the rear end of the sheet 83 has been reached the place for recording in the mechanical section for printing 89, a series of recording operations is completed, and the sheet 83 is ejected.

In the present embodiment, as shown in FIG. 2, a recovering device 117 is provided at an end of the moving range, outside of the recording range, of the carriage 93 to recover the inkjet head 94 from discharge failures. The recovering device 117 includes a capping means, a suctioning means, and a cleaning means.

The carriage 93 is moved to a position opposite to the recovering device 117 while waiting for printing, to have the nozzle surface of the inkjet head 94 capped with the capping means. This make it possible to keep the nozzles moist, which protects the carriage 93 from discharge failures possibly caused by ink dehydration. Also, by discharging the ink whose colors are not relevant to a particular recording at the recovering device 117, which is called blank discharge, all the discharging holes have the same ink viscosity to keep stable discharge performance.

If a discharge failure occurs, the nozzles of the inkjet head 94 are sealed up by the capping means, then, bubbles are suctioned from the nozzles with ink through tubes by the suctioning means. Ink or dust sticking to the nozzle surface is removed by a wiper, or the cleaning means. With these operations, the inkjet head 94 may be recovered from a discharge failure. The suctioned ink is dumped into a waste ink reservoir (not shown) provided at a lower part of the main body, and kept in an ink absorber in the waste ink reservoir.

Figure 4:
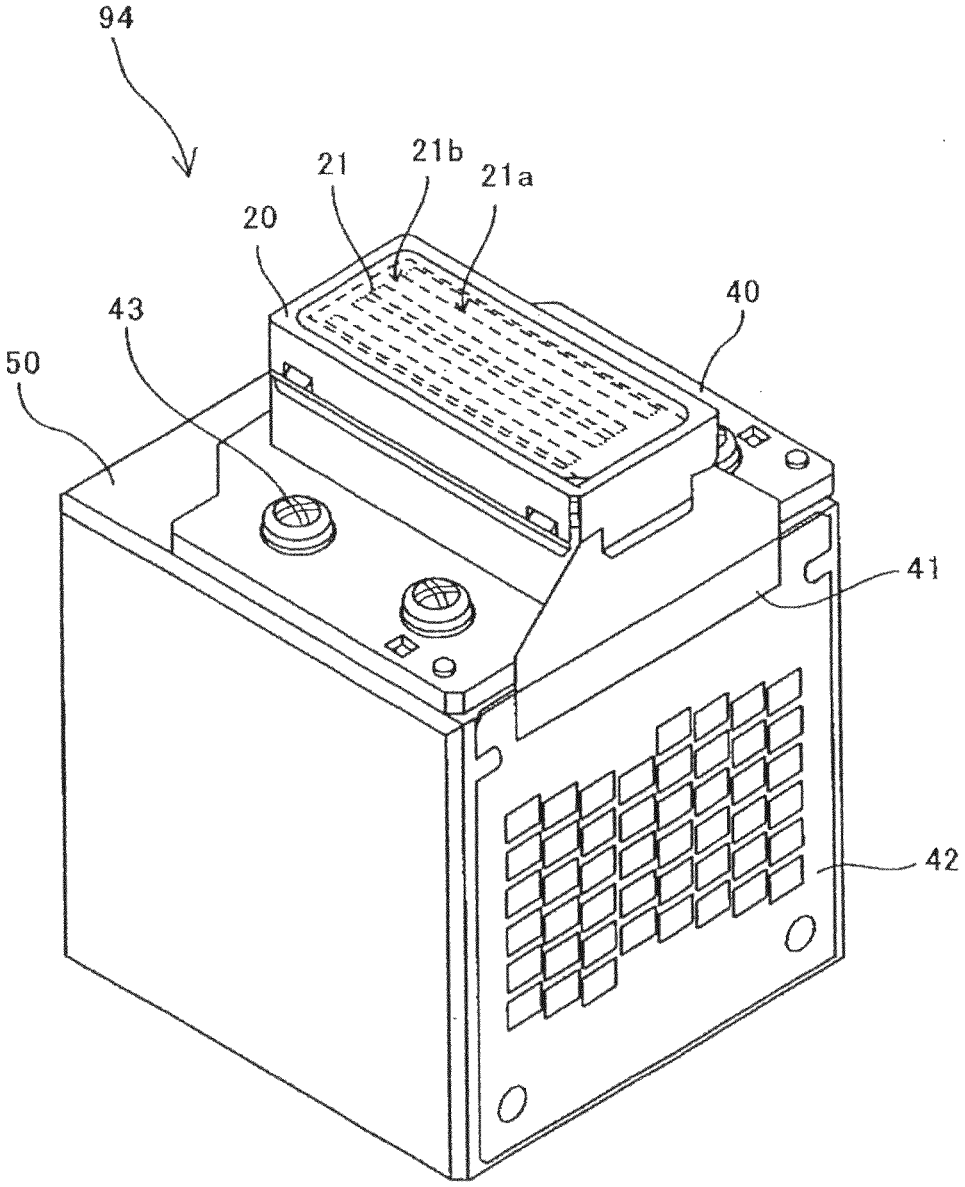
FIG. 4 is an external perspective view of an inkjet head according to an embodiment.
Figure 5:
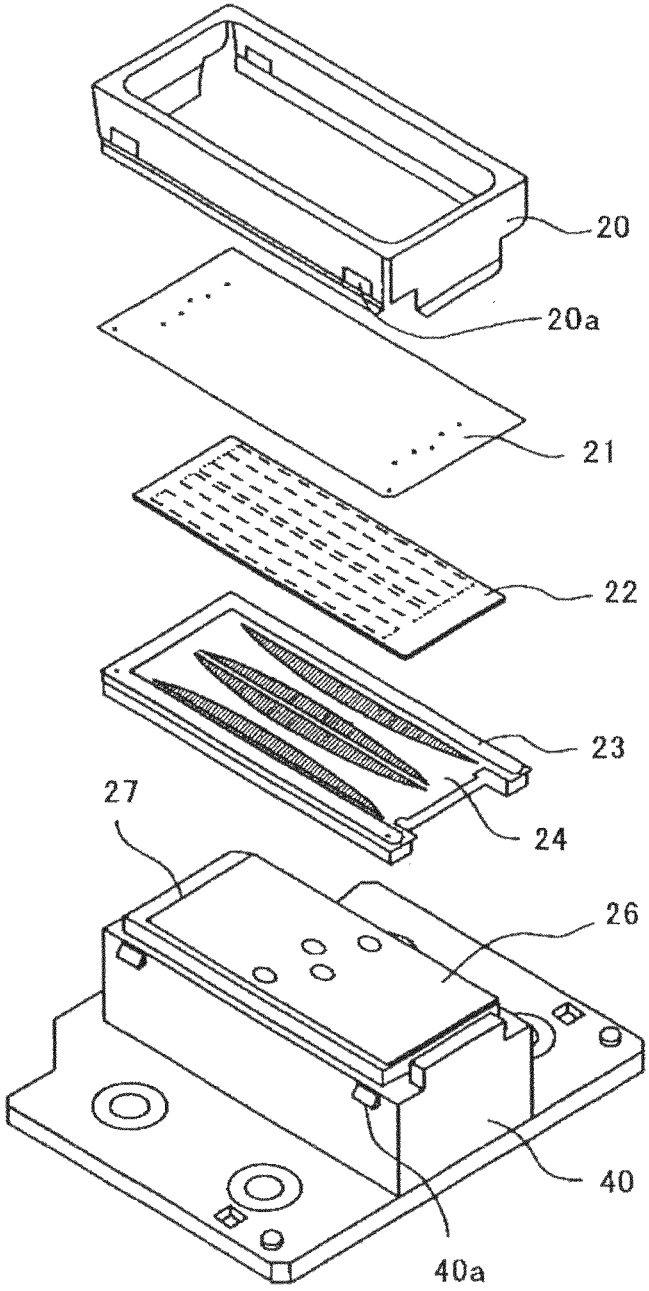
FIG. 5 is an exploded perspective view of an inkjet head.

Next, the inkjet head 94 will be explained according to the present embodiment. FIG. 4 is an external perspective view of the inkjet head 94 according to an embodiment, and FIG. 5 is an exploded perspective view of the inkjet head 94.

The inkjet head 94 has a nozzle plate 21 on which multiple ink discharging holes 21*a* to discharge ink are arranged to form a nozzle surface 21*b* opposite to a sheet 83. The inkjet head 94 also has an actuator substrate 22 on which individual liquid chambers, or pressure generating chambers, in which pressure is generated to discharge ink from the ink discharging holes 21*a*, are formed along with electromechanical transducers. An electromechanical transducer includes a lower electrode, a piezoelectric device, and an upper electrode on a vibrating plate to apply pressure on the individual liquid chamber. The inkjet head 94 also has a common passage substrate 24 provided with a common passage to supply ink to the individual liquid chambers. The inkjet head 94 also has a nozzle cover 20 as a cover member to cover at least a perimeter of the nozzle surface 21*b* of the nozzle plate 21, with an opening formed to expose the ink discharging holes 21*a* and the periphery of the ink discharging holes 21*a*. The inkjet head 94 also has a reference surface for positioning perpendicular to the lines of nozzles, and a housing 40 to be attached with the common passage substrate 24, the actuator substrate 22, the nozzle plate 21, and the nozzle cover 20, via damper members 26 and 27. The inkjet head 94 also has a tank holder 50 to hold multiple ink tanks (not shown), fixed to the housing 40 with screws 43 as fixing means.

The common passage substrate 24, the damper members 26, 27, and the housing 40 provide ink supplying passages communicating with the ink discharging holes 21*a*, disposed appropriately for lines of nozzles, to supply colors of ink from the ink tanks to the individual liquid chambers and the lines of nozzles formed on the actuator substrate 22.

The inkjet head 94 also has a connector substrate 42 provided with electrical pads to transmit electrical signals according to a recording image, to be connected electrically to a connector (not shown) provided in an inkjet recording apparatus, and FPC (flexible printed circuits) 41 to electrically connect the connector substrate 42 and a pad section connected electrically to driver ICs (not shown) to drive the electromechanical transducers provided on the actuator substrate 22. The inkjet head 24 is configured in such a way that electrical signals transmitted from the inkjet recording apparatus according to a recording image, are supplied to the actuator substrate 22 provided with the electromechanical transducers, through the connector substrate 42 and the FPC 41, which is converted to mechanical vibrations to apply pressure to ink in the individual liquid chambers via the vibrating plates to discharge ink from the ink discharging holes 21*a* to a sheet 83 with high precision.

The nozzle plate 21 has four lines of nozzles on the nozzle surface 21*b* formed with the multiple ink discharging holes 21*a* for each of the lines of nozzles, to discharge four colors of ink with a single inkjet head 94. As a material for the nozzle plate 21, it is suitable to use a plate made of stainless steel or the like, on which ink discharging holes 21*a* may be preferably formed with press work.

Also, surface treatment is applied to the nozzle plate 21 with a liquid repellent material to avoid discharge failures such as a deviated discharge of ink caused by non-uniform ink adherence. As a liquid repellent material, it is suitable to use organic materials including fluorocarbon whose surface energy is small, which are applied to the surface of the nozzle plate 21 with a preferable method such as vapor deposition or dipping.

On the surface of the nozzle plate 21 attaching to the actuator substrate 22, the liquid repellent material is removed by treating with oxygen plasma or the like, to be attached to the actuator substrate 22 with an adhesive coated on the surface of the actuator substrate 22. As an adhesive for this purpose, an adhesive highly unsoluble to ink used in the inkjet recording apparatus may be used. Specifically, a thermosetting adhesive containing epoxy resin or silicone resin may be used preferably.

The nozzle cover 20 has an opening to expose the ink discharging holes 21*a* formed on the nozzle plate 21. The nozzle cover 20 has a nearly box-shaped form folded to cover the end surfaces of the common passage substrate 24 and a connecting section of the FPC 41 and the actuator substrate 22. The nozzle cover 20 has a hole 20*a* to be fit with a projection 40*a* on the housing 40, to be attached to the housing 40.

As a material of the nozzle cover 20, the same material used for the nozzle plate 21, which is stainless steel, may be used. By applying the liquid repellent material, which is applied to the surface of the nozzle plate 21, to the surface of the nozzle cover 20, it is possible to prevent ink from adhering to the nozzle cover 20.

The electromechanical transducers formed on the actuator substrate 22 have been processed with the micro machining technology, which is a semiconductor device manufacturing technology using the sol-gel method to make it possible to achieve high density of the electromechanical transducers easily.

The sol-gel method is, as described in the Non-Patent Document 1, a method to produce an inorganic oxide by having an organometallic compound, such as metal alkoxide, hydrolyzed and polycondensed in a solution system to grow metal-oxygen-metal bonds, to be completed with sintering. Piezoelectric materials formed into a film by the sol-gel method include materials lead zirconate titanate (PZT) or the like. PZT can be obtained by dissolving initial materials, lead acetate, zirconium isopropoxide, and titanium isopropoxide, into methoxy ethanol used as a common solution. PZT may be preferably used here.

The common passage substrate 24 is formed with multiple sheets of layered members, which include at least the first plate member to be attached to the actuator substrate 22, and the second member to be attached to the damper member 26. As a material for the first member, stainless steel or ferronickel alloy may be used preferably, to which various processing methods may be applicable such as press work, etching, or laser machining. Press work may be preferably used in terms of cost. The second member may be preferably made of a resin containing polyphenylene sulfide, with injection molding.

The frame member 23 is formed with the same material used for the second member used in the common passage substrate 24. The frame member 23 is formed in at least a part of the space surrounded by the opposing surface of the ink-discharging surface of the nozzle plate 21, the surface of the common passage substrate 24 facing to the nozzle plate 21, and external side surfaces of the actuator substrate 22.

Also, the frame member 23 can take various forms according to the dimensions of the actuator substrate 22.

Figure 6A:
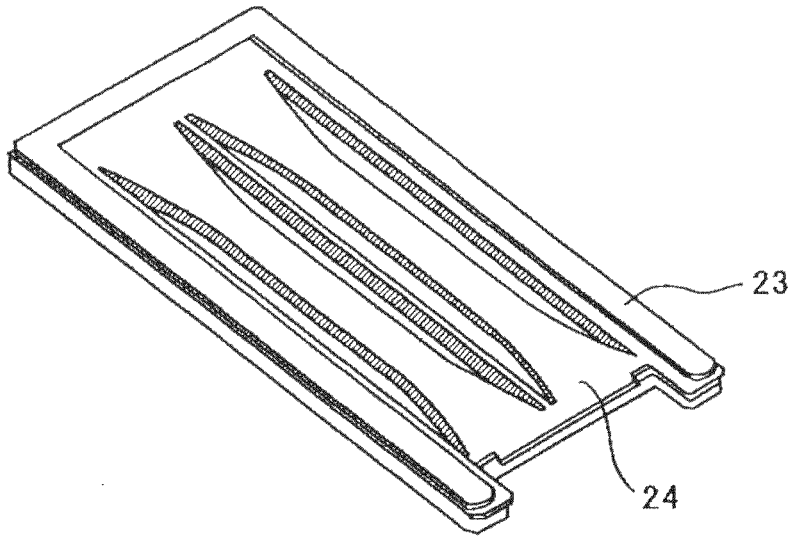
FIG. 6A is a perspective view of a common passage substrate in a case that a frame member is provided on three edges of the perimeter of the common passage substrate.
Figure 6B:
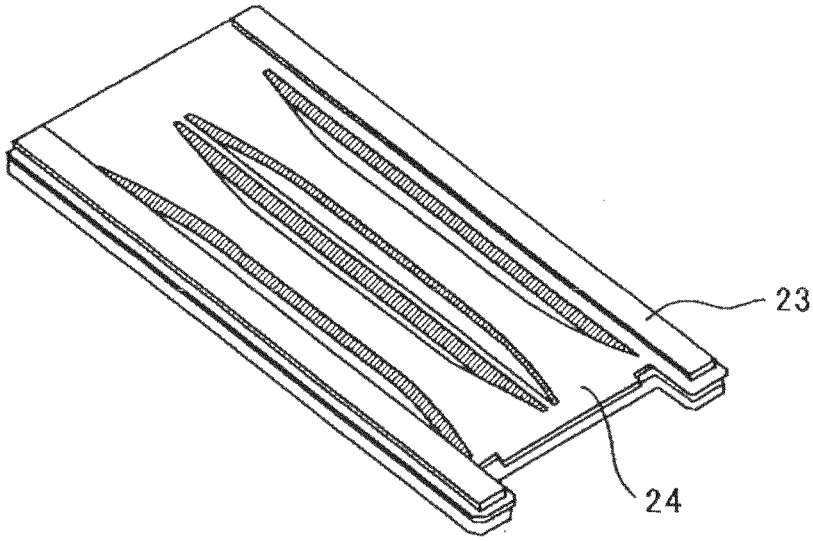
FIG. 6B is a perspective view of a common passage substrate in a case that a frame member is provided on two edges of the perimeter of the common passage substrate.
Figure 6C:
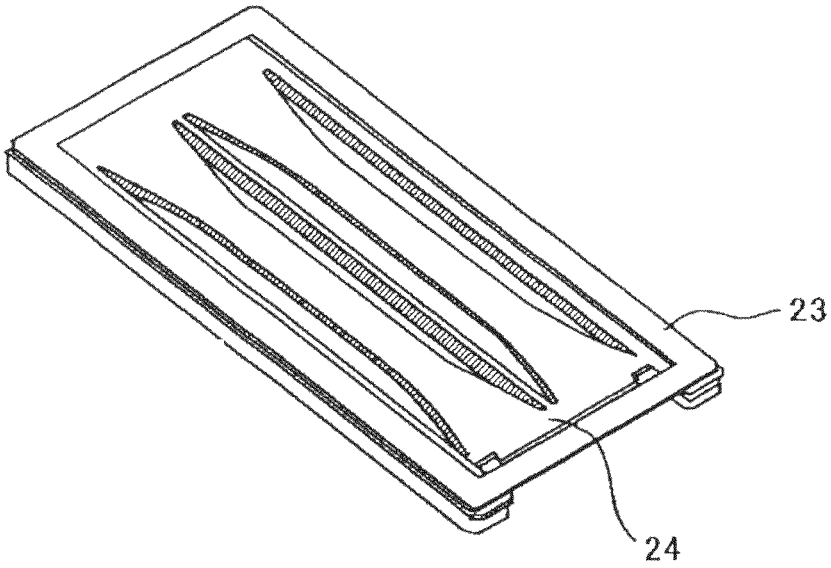
FIG. 6C is a perspective view of a common passage substrate in a case that a frame member is provided on four edges of the perimeter of the common passage substrate.

FIG. 6A is a perspective view of the common passage substrate 24 in a case that the frame member 23 is provided on three edges of the perimeter of the common passage substrate 24. FIG. 6B is a perspective view of the common passage substrate 24 in a case that the frame member 23 is provided on two edges of the perimeter of the common passage substrate 24. FIG. 6C is a perspective view of the common passage substrate 24 in a case that the frame member 23 is provided on four edges of the perimeter of the common passage substrate 24.

In FIG. 6A, the frame member 23 is provided on three edges out of four sides forming the perimeter of the common passage substrate 24, on the surface of the common passage substrate 24 to be attached to the actuator substrate 22. In FIG. 6B, the frame member 23 is provided on two longitudinal edges of the perimeter of the common passage substrate 24, on the surface of the common passage substrate 24. In FIG. 6C, the frame member 23 is provided on all four edges on the surface of the common passage substrate 24.

As shown in FIGS. 6A-6C, it is possible to provide the frame member 23 on at least a part of edges on the surface of the common passage substrate 24 to be attached to the actuator substrate 22.

The common passage substrate 24 and the frame member 23 may be preferably formed in one unit with insert molding. Namely, surface treatment is applied in advance to the surface of a metal material, which is the first material forming the common passage substrate 24, to be adhered to melted resin. Then, the first material is inserted to a die for injection molding. Melted resin, then, is injected into the die having the first material already inserted, to be attached firmly to the first material. When taken out from the die, the common passage substrate 24 and the frame member 23 are formed in one unit. Thus, it is possible to reduce cost because an additional process is not needed to attach the common passage substrate 24 with the frame member 23.

Figure 7:
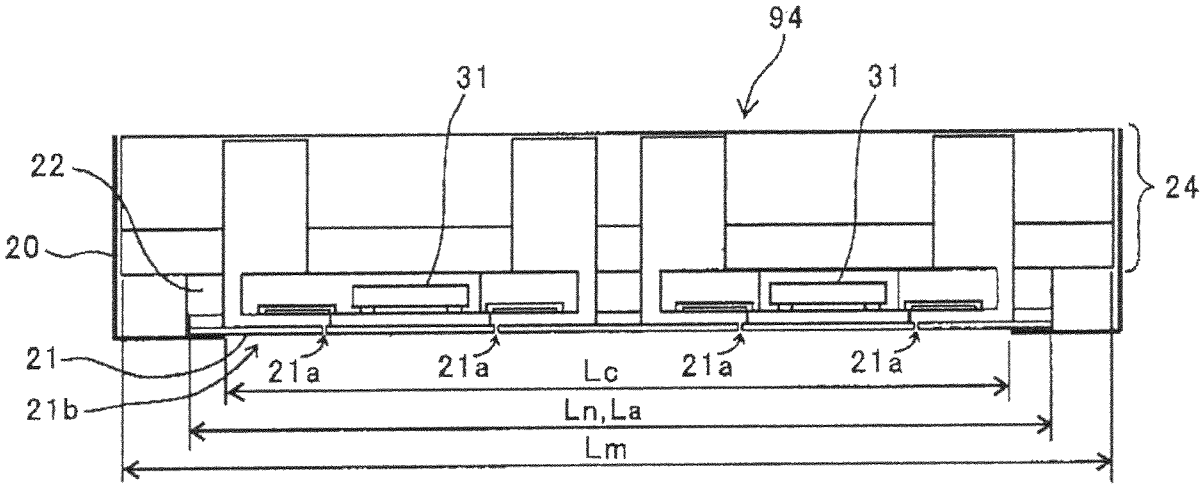
FIG. 7 is a cross-sectional view of a conventional inkjet head illustrating a relationship among an external dimension of an actuator substrate, an external dimension of an opening of a nozzle cover, an external dimension of a nozzle plate, and an external dimension of the common passage substrate.
Figure 8A:
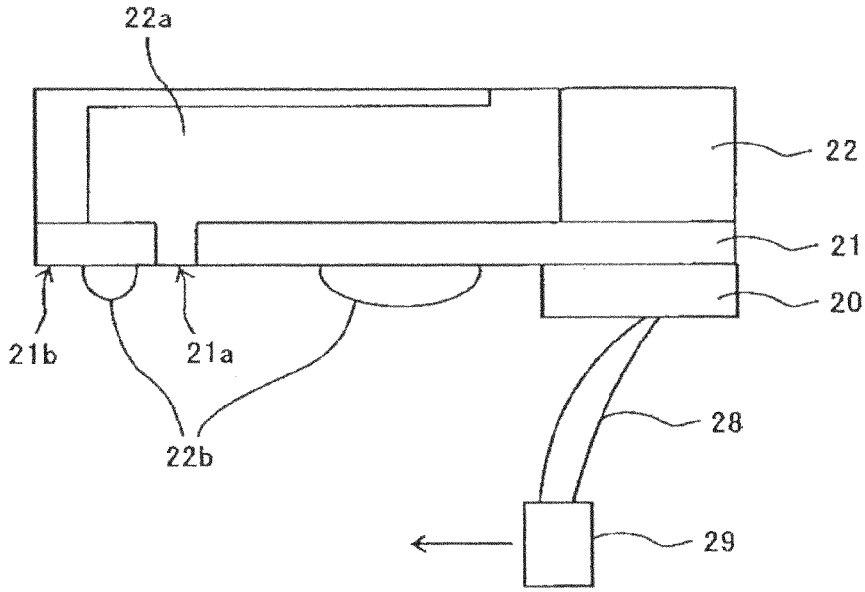
FIG. 8A-8C are enlarged views of an ink discharging hole.
Figure 8B:
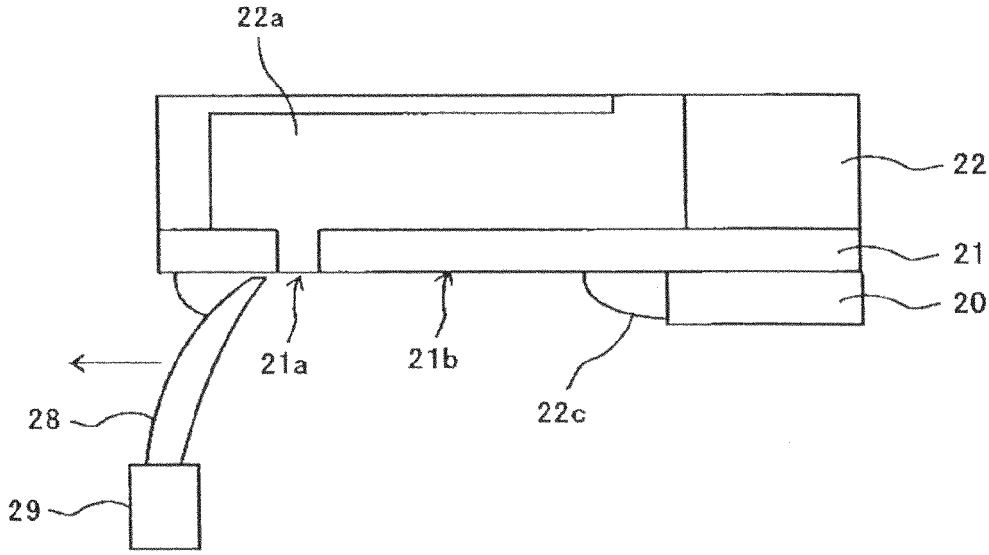
Figure 8C:
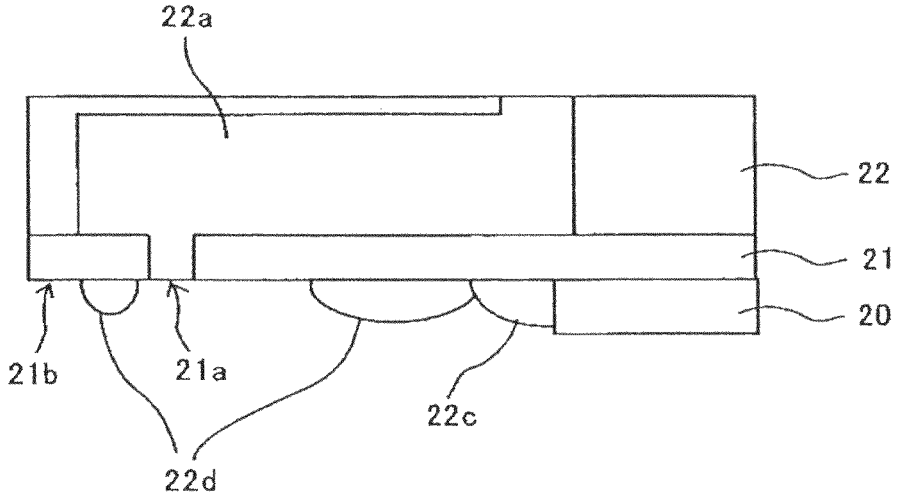

FIG. 7 is a cross-sectional view of a conventional inkjet head 94 illustrating a relationship among an external dimension of the actuator substrate 22 La, an external dimension of the opening of the nozzle cover 20 Lc, an external dimension of the nozzle plate 21 Ln, and an external dimension of the common passage substrate 24 Lm. FIGS. 8A-8C are enlarged schematic views of the ink discharging hole 21*a* from which ink 22*a* is discharged from the individual chamber on the actuator substrate 22.

First, an example of a conventional inkjet head 94 is shown in FIG. 7. In a conventional inkjet head, at least the actuator substrate 22 and the nozzle plate 21 are formed with nearly the same external dimension. Also, the nozzle cover 20 is positioned to cover the surface of the nozzle plate 21 and the end surfaces of the nozzle plate 21, the actuator substrate 22, and the common passage substrate 24. Also, it is configured to satisfy inequalities, $Lc<Ln\leq La\leq Lm$.

The conventional inkjet head 94 is also configured to secure a certain amount of overlap between the nozzle plate 21 and the actuator substrate 22 to secure a rigidity of the nozzle cover 20. However, this makes the distance between the edge of the opening of the nozzle cover 20 and the ink discharging hole 21*a* in the nozzle plate 21 shorter. In such a case, as shown in FIG. 8A-8C, a step portion formed with the edge of the opening of the nozzle cover 20 and the surface of the nozzle plate 21 gets closer to the ink discharging hole 21*a*.

Then, when the wiper 28, which is held by the wiper holding section 29, moves relative to the inkjet head 94, to wipe ink 22*b* adhering to the surface of the nozzle plate 21, the wiper 28 may not be able to wipe off the ink 22*b* completely, which forms a puddle of residual ink 22*c* at the step portion. Moreover, if new ink 22*d* adheres to the vicinity of the puddle of the ink 22*c* already pooling up at the step portion, the piled up ink may reach the ink discharging hole 21*a* to stain the surface of the nozzle plate 21 around the ink discharging hole 21*a*. Therefore, there is a risk to induce a discharge failure such as a deviated discharge in which ink discharged from the ink discharging hole 21*a* is deviated from a right direction.

Figure 1:
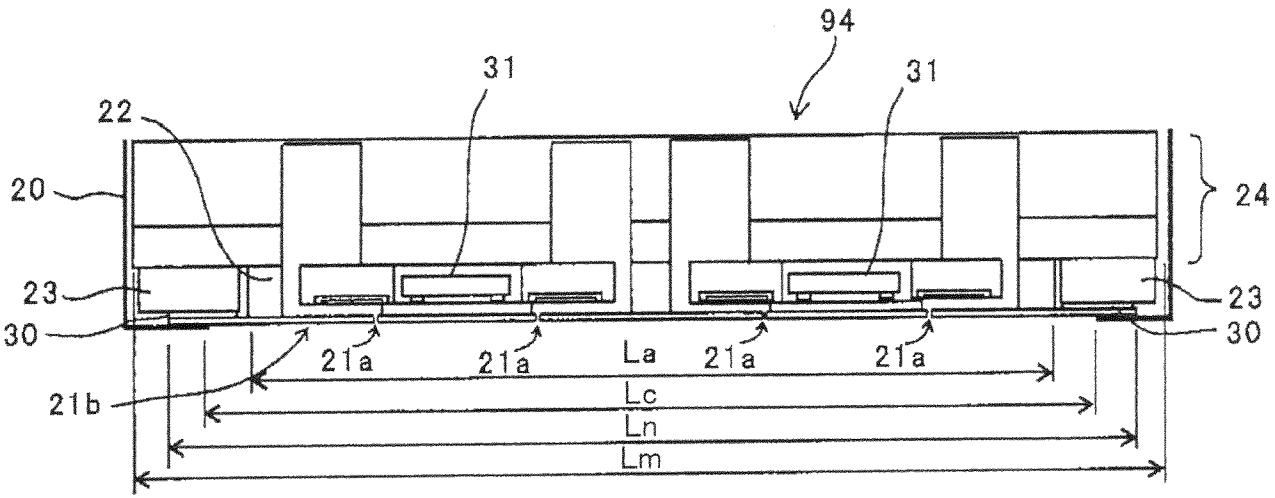
FIG. 1 is a cross-sectional view of an inkjet head illustrating a relationship among an external dimension of an actuator substrate, an external dimension of an opening of a nozzle cover, an external dimension of a nozzle plate, and an external dimension of the common passage substrate according to an embodiment of the present invention.

FIG. 1 shows an inkjet head 94 according to the present embodiment. In FIG. 1, an external dimension of the actuator substrate 22 La, an external dimension of the opening of a nozzle cover 20 Lc, an external dimension of the nozzle plate 21 Ln, and an external dimension of the common passage substrate 24 Lm are configured to satisfy inequalities, $La<Lc<Ln\leq Lm$.

Also, the frame member 23 is formed in the space surrounded by the opposing surface to the surface with ink discharging holes 21*a* of the nozzle plate 21, a surface of the common passage substrate 24 facing to the nozzle plate 21, and side surfaces of the actuator substrate 22, to support the perimeter of the nozzle plate 21.

Taking this configuration, it is possible to make the actuator substrate 22 whose manufacturing cost is expensive, smaller. Also, the nozzle plate can be prevented from deforming when the nozzle cover 20 touched by the wiper 28 pushes the nozzle plate 21. Also, it is possible to make the distance between the edge of the opening of the nozzle cover 20 and the ink discharging hole 21*a* longer than a conventional inkjet head 94. Therefore, if ink is pooling up at the step portion formed with the edge of the opening of the nozzle cover 20 and the surface of the nozzle plate 21, it becomes unlikely that the residual ink reaches the surface of the nozzle plate 21 around the ink discharging hole 21*a*. Therefore, a discharge failure, such as a deviated discharge which could be caused by a stained surface around the ink discharging hole 21*a* of the nozzle plate 21, becomes less likely to happen.

Also, the frame member 23 may be formed thinner than the plate thickness of the actuator substrate 22 to form a gap between the frame member and the nozzle plate 21 to be filled with a filling material 30. This makes the frame member 23 and the nozzle plate 21 fixed more firmly to each other, which prevents ink from getting into the inside of the inkjet head 94 to improve the reliability of the inkjet head 94.

Figure 9:
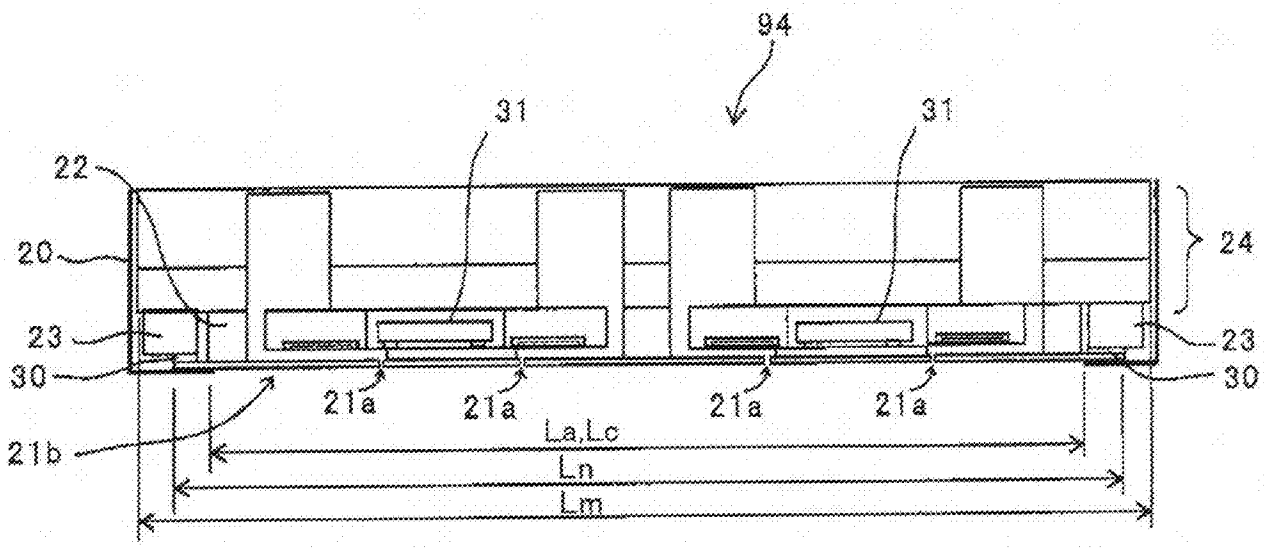
FIG. 9 is a cross-sectional view of an inkjet head illustrating a relationship among an external dimension of an actuator substrate, an external dimension of an opening of a nozzle cover, an external dimension of a nozzle plate, and an external dimension of the common passage substrate according to an embodiment of the present invention.
Figure 10:
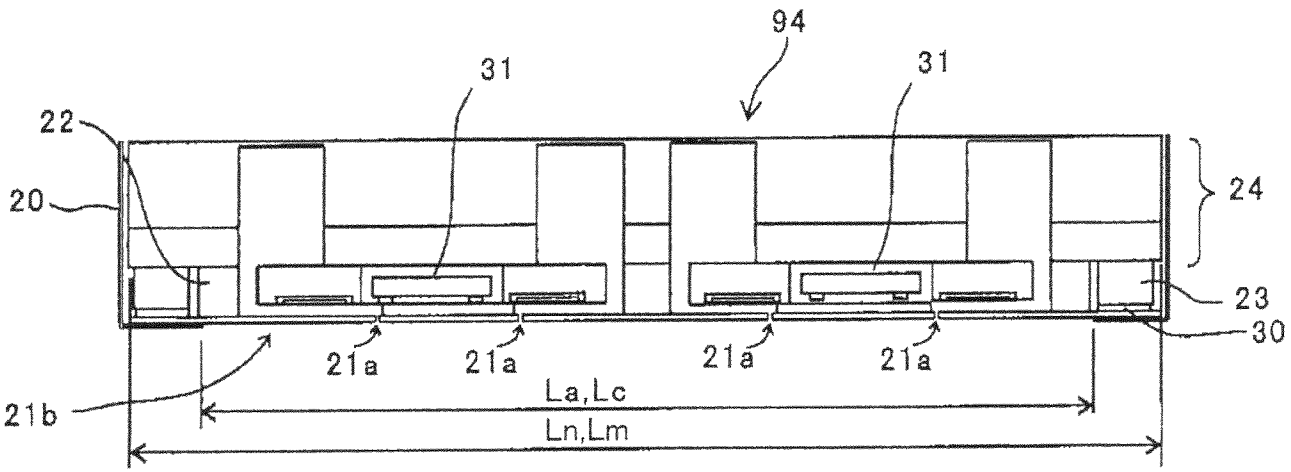
FIG. 10 is a cross-sectional view of an inkjet head illustrating a relationship among an external dimension of an actuator substrate, an external dimension of an opening of a nozzle cover, an external dimension of a nozzle plate, and an external dimension of the common passage substrate according to an embodiment of the present invention; and, FIG. 11 is a cross-sectional view of an inkjet head illustrating a relationship among an external dimension of an actuator substrate, an external dimension of an opening of a nozzle cover, an external dimension of a nozzle plate, and an external dimension of the common passage substrate according to an embodiment of the present invention.
Figure 11:
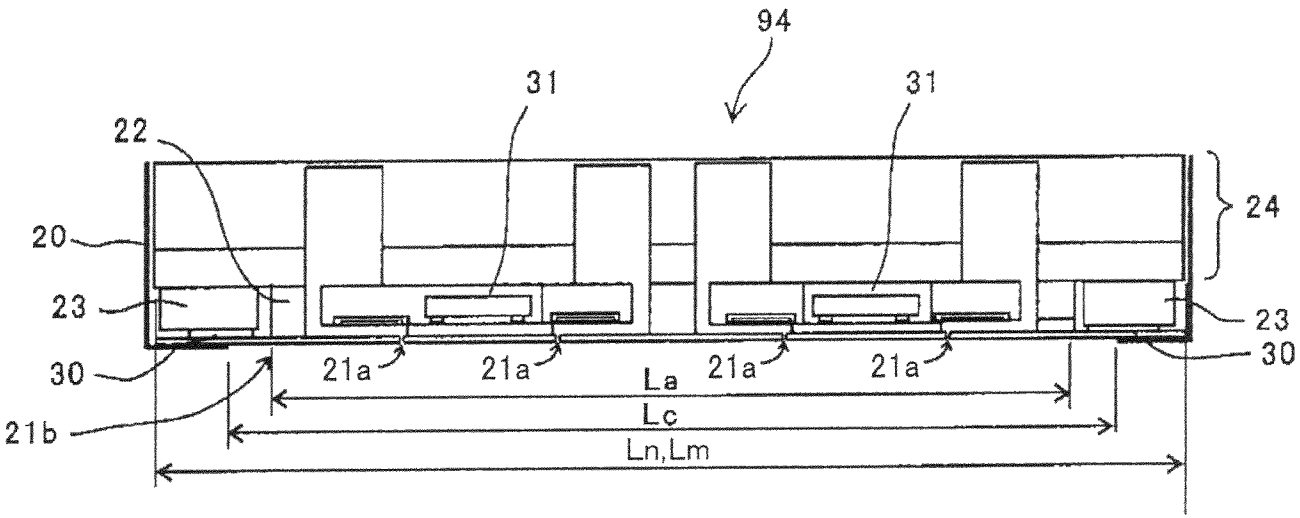

FIG. 9, FIG. 10, and FIG. 11 show alternative configurations of the inkjet heads 94 according to the present embodiment.

In FIG. 9, the external dimension of the actuator substrate 22 La, the external dimension of the opening of the nozzle cover 20 Lc, the external dimension of the nozzle plate 21 Ln, and the external dimension of the common passage substrate 24 Lm are configured to satisfy inequalities, La=Lc<Ln<Lm.

In FIG. 10, the external dimension of the actuator substrate 22 La, the external dimension of the opening of the nozzle cover 20 Lc, the external dimension of the nozzle plate 21 Ln, and the external dimension of the common passage substrate 24 Lm are configured to satisfy inequalities, La=Lc<Ln=Lm.

In FIG. 11, the external dimension of the actuator substrate 22 La, the external dimension of the opening of the nozzle cover 20 Lc, the external dimension of the nozzle plate 21 Ln, and the external dimension of the common passage substrate 24 Lm are configured to satisfy inequalities, La<Lc<Ln=Lm.

Any of the configurations in FIG. 9, FIG. 10, or FIG. 11, has the same effects as the configuration shown in FIG. 1.

In addition to the examples above, various aspects of the invention have specific effects as follows.

(Aspect A)

An inkjet head includes:

an actuator substrate provided with a pressure generating chamber;

a nozzle plate provided with multiple nozzle holes discharging liquid stored in the pressure generating chamber by a pressure generating section, the multiple nozzle holes being formed on a nozzle surface opposite to a recording media;

a common passage substrate provided with a common passage to supply liquid to the pressure generating chamber; and a cover member to cover at least a perimeter of the nozzle surface, with an opening formed to expose the nozzle holes and a periphery of the nozzle holes.

The inkjet head is configured in such a way that, in a prescribed direction, a dimension of the opening of the cover Lc, an external dimension of the actuator substrate La, an external dimension of the nozzle plate Ln, and an external dimension of the common passage substrate Lm, satisfy inequalities, La≤Lc<Ln≤Lm, and a supporting member is provided in a space surrounded by an opposing surface of the nozzle surface of the nozzle plate, a surface of the common passage substrate facing to the nozzle plate, and external side surfaces of the actuator substrate, to support the nozzle plate by attaching to the opposing surface of the nozzle surface and the surface of the common passage substrate facing to the nozzle plate.

Configured as above, it is possible to provide an inkjet head with a lower cost without deteriorating print quality as described with the embodiments earlier.

(Aspect B)

In the inkjet head configured as described in Aspect A, the supporting member may be formed on at least a part a perimeter of the surface of the common passage substrate facing to the nozzle plate.

(Aspect C)

In the inkjet head configured as described in Aspect A or B, a plate thickness of the supporting member tb and a plate thickness on the actuator substrate to satisfy an inequality, tb≤ta, to form a gap between the supporting member and the nozzle plate, which is filled with a filling material.

Configured as above, it is possible to improve the reliability of the inkjet head as described with the embodiments earlier.

(Aspect D)

In the inkjet head configured as described in Aspect A to C, the common passage substrate and the supporting member are combined into a unit with a metal material and a resin material.

Configured as above, it is possible to reduce the cost of the inkjet head as described with the embodiments earlier.

(Aspect E)

In the inkjet head configured as described in Aspect D, at least a part of the common passage substrate may be formed with a metal material, every surface of the metal material or a surface of the metal material contacting to the resin material may be applied with surface treatment.

(Aspect F)

In the inkjet head configured as described in Aspect D or E, the metal material may be preferably a stainless steel.

(Aspect G)

In the inkjet head configured as described in Aspect D, E or F, the resin material may be preferably a resin including polyphenylene sulfide.

(Aspect H)

In the inkjet head configured as described in Aspect A, B, C, D, E, F, or G, the pressure generating section may preferably have an electromechanical transducer.

(Aspect I)

In the inkjet head configured as described in Aspect H, the electromechanical transducer may be formed with using a sol-gel method.

Configured as above, it is possible to achieve high density of the electromechanical transducers easily as described with the embodiments earlier.

(Aspect J)

An inkjet recording apparatus is provided with the inkjet head configured as described in Aspect A to I. Configured as above, it is possible to lower the cost without deteriorating print quality as described with the embodiments earlier.

Further, the present invention is not limited to these embodiments, examples and aspects, but various variations and modifications may be made without departing from the scope of the present invention.

The present application is based on Japanese Priority Application No. 2012-034376, filed on Feb. 20, 2012, with the Japanese Patent Office, the entire contents of which are hereby incorporated by reference.

What is claimed is:

1. An inkjet head comprising:

an actuator substrate provided with a pressure generating chamber;

a nozzle plate provided with multiple nozzle holes discharging liquid stored in the pressure generating chamber by a pressure generating section, the multiple nozzle holes being formed on a nozzle surface opposite to a recording media;

a common passage substrate provided with a common passage to supply liquid to the pressure generating chamber; and a cover member to cover at least a perimeter of the nozzle surface, with an opening formed to expose the nozzle holes and a periphery of the nozzle holes, wherein, in a prescribed direction, a dimension of the opening of the cover Lc, an external dimension of the actuator substrate La, an external dimension of the nozzle plate Ln, and an external dimension of the common passage substrate Lm, satisfy inequalities, $La \leq Lc < Ln \leq Lm$, wherein a supporting member is provided in a space surrounded by an opposing surface of the nozzle surface of the nozzle plate, a surface of the common passage substrate facing to the nozzle plate, and external side surfaces of the actuator substrate, to support the nozzle plate by attaching to the opposing surface of the nozzle surface and the surface of the common passage substrate facing to the nozzle plate.

2. The inkjet head as claimed in claim 1, wherein the supporting member is formed on at least a part a perimeter of the surface of the common passage substrate facing to the nozzle plate.

3. The inkjet head as claimed in claim 1, wherein a plate thickness of the supporting member tb and a plate thickness on the actuator substrate to satisfy an inequality, $tb \leq ta$, to form a gap between the supporting member and the nozzle plate, the gap being filled with a filling material.

4. The inkjet head as claimed in claim 1, wherein the common passage substrate and the supporting member are combined into a unit with a metal material and a resin material.

5. The inkjet head as claimed in claim 4, wherein at least a part of the common passage substrate is formed with a metal material, every surface of the metal material or a surface of the metal material contacting to the resin material is applied with surface treatment.

6. The inkjet head as claimed in claim 4, wherein the metal material is a stainless steel.

7. The inkjet head as claimed in claim 4, wherein the resin material is a resin including polyphenylene sulfide.

8. The inkjet head as claimed in claim 1, wherein the pressure generating section has an electromechanical transducer.

9. The inkjet head as claimed in claim 8, wherein the electromechanical transducer is formed with using a sol-gel method.

10. An inkjet recording apparatus provided with the inkjet head as claimed in claim 1.

* * * * *